United States Patent [19]

Goloff et al.

[11] 4,366,785

[45] Jan. 4, 1983

[54] TAPPET WITH WEAR RESISTING INSERT

[75] Inventors: Alexander Goloff, East Peoria; Paul J. Staebler, Dunlap, both of Ill.

[73] Assignee: Caterpillar Tractor Co., Peoria, Ill.

[21] Appl. No.: 251,521

[22] PCT Filed: Sep. 19, 1980

[86] PCT No.: PCT/US80/01223

§ 371 Date: Sep. 19, 1980

§ 102(e) Date: Sep. 19, 1980

[87] PCT Pub. No.: WO82/01034

PCT Pub. Date: Apr. 1, 1982

[51] Int. Cl.[3] ..... F01L 1/14

[52] U.S. Cl. ..... 123/90.51

[58] Field of Search ..... 123/90.48, 90.51; 29/156.7 B

[56] References Cited

U.S. PATENT DOCUMENTS

| | | | |
|---|---|---|---|
| 1,402,226 | 1/1922 | Germonprez | 123/90.51 |
| 2,817,144 | 12/1957 | Zeller | 123/90.51 |
| 2,891,525 | 6/1959 | Moore | 123/90.51 |
| 2,987,815 | 6/1961 | Zeller | 123/90.51 |
| 3,073,292 | 1/1963 | Behnke et al. | 123/90.51 |
| 3,198,182 | 8/1965 | Robinson et al. | 123/90.51 |

FOREIGN PATENT DOCUMENTS

| | | | |
|---|---|---|---|
| 745737 | 4/1944 | Fed. Rep. of Germany | 123/90.51 |
| 746468 | 8/1944 | Fed. Rep. of Germany | 123/90.51 |
| 2209926 | 9/1972 | Fed. Rep. of Germany | 123/90.51 |
| 1020632 | 2/1953 | France | 123/90.51 |
| 928744 | 6/1955 | Netherlands | 123/90.51 |
| 241374 | 10/1925 | United Kingdom | 123/90.51 |

*Primary Examiner*—Craig R. Feinberg
*Assistant Examiner*—W. R. Wolfe
*Attorney, Agent, or Firm*—Anthony N. Woloch

[57] ABSTRACT

A tappet (10) for an internal combustion engine having a main body (12) and an annular rim (17) extending therefrom with a ceramic wear resisting insert (20) flush therewith and maintained therein by means of an interference fit. This tappet (10) need have a wear face (14) not as great in diameter as the distance of potential contact between a cam (16) and a wear face of infinitely extended surface. The tappet (10) yielded has a very long life and a low incidence of failure.

1 Claim, 3 Drawing Figures

TAPPET WITH WEAR RESISTING INSERT

TECHNICAL FIELD

This invention relates generally to tappets for use in internal combustion engines and more particularly to tappets having inserts designed to resist wear resulting from cam contact.

BACKGROUND ART

The cam contacting face of tappets used in internal combustion engines is subjected to the significant abrading and heat inducing action of a cam repeatedly striking and rubbing across it. As this face becomes worn, tappet travel is changed causing valve motion to be altered consequently affecting engine performance. Eventually, engine performance is decreased to the point where rectification of this problem is mandatory. Wear of the tappet can also result in damage to the cam that drives it.

Extensive efforts have been made to minimize tappet wear so as to avoid the consequent problems. Most attempts at a solution to this wear have centered on providing a hardened face for cam contact. In U.S. Pat. No. 2,817,144 issued to Zeller on May 25, 1953 there is disclosed a tappet with a carbide facing attached thereto by brazing. This development and refinements thereof are commonly used improvements on the standard tappet. All suffer the defect of relying on a brazed joint for adherence of the wear resisting face to the tappet proper. Stresses on this joint due to differing coefficients of thermal expansion between the joined surfaces can result in separation of the wear resisting surface from the tappet.

Many other schemes for joining hardened surfaces to tappets have been proposed, none of which yield a totally satisfactory product. Robinson et al in U.S. Pat. No. 3,198,182 issued Aug. 3, 1965 describe a tappet including a hardened wear face formed and bonded to the tappet by techniques of powder-metallurgy. Such tappets are very expensive and consequently are not widely used.

German Pat. No. 2,209,926 issued to Bertinetti on Sept. 14, 1972 discloses a tappet formed of a steel wear face implanted in a plastic or nylon main body. In this invention, the wear face is embedded in the tappet during the molding of the plastic main body. Such a tappet would be limited in application to engines in which the tappet temperature and mechanical loadings are sufficiently low so as to be within the material limitations of the synthetic substance from which the main body is fabricated.

French Pat. No. 1,020,632, issued to Robig on Feb. 9, 1953, relates to a tappet with a hardened cam contacting wear face made of cast iron or some ceramic material. In this invention the insert is retained in place by a dovetailed joint, the tappet main body being cast with the prefashioned dovetailed wear surface in place. A drawback of this invention is the expense of casting the tappet with the wear resisting insert in place. Also, if the insert is metallic, detrimental metallurgic changes can occur within it should its temperature be sufficiently elevated in the process of casting the tappet main body around it.

The present invention is directed to overcoming one or more of the problems as set forth above.

DISCLOSURE OF THE INVENTION

In one aspect of the present invention a tappet for use in an internal combustion engine has a main body and a cam contacting face that is especially wear resistant. This cam contacting face includes an annular rim extending outward from the tappet main body, this rim defining a recess in which is set a wear resisting insert retained by an interference fit and being preferably fashioned of a ceramic material. The face of the rim and the wear resisting insert are substantially flush.

BRIEF DESCRIPTION OF THE DRAWINGS

For a better understanding of the present invention, reference may be had to the accompanying drawings in which.

BEST MODE FOR CARRYING OUT THE INVENTION

Figure 1:
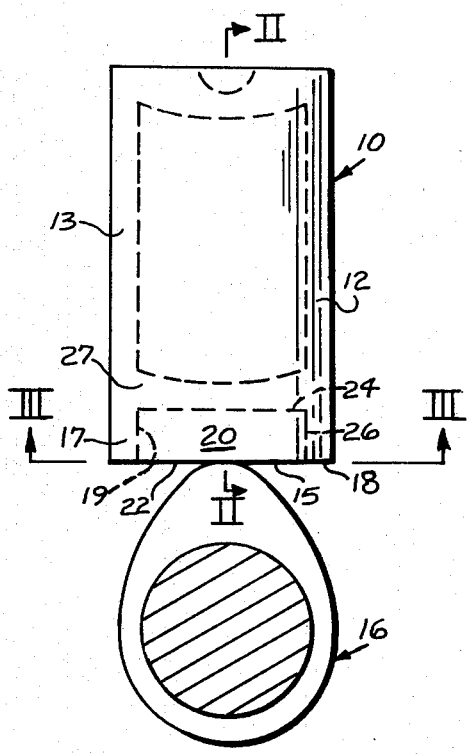
FIG. 1 is a diagrammatic side view of an embodiment of the present invention and its corresponding cam.
Figure 2:
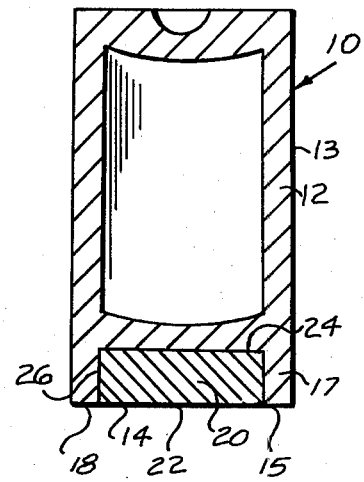
FIG. 2 is a cross sectional view of the present invention taken along line II—II of FIG. 1.
Figure 3:
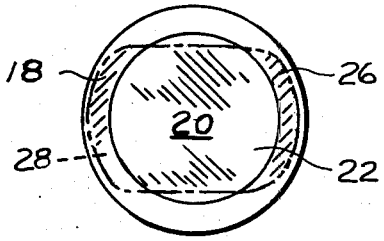
FIG. 3 is a bottom view of the present invention taken along line III—III of FIG. 1.

Referring to the drawings a tappet 10 is substantially cylindrical having a main body 12 and an outer cylindrical surface 13. The main body 12 is preferably made of cast iron but also can be fashioned of steel, nonferrous alloys or other substances known to those skilled in the art. The main body 12 has an annular rim 17, itself having a rim end surface 18 extending to form one end 15 of said tappet 10, the rim 17 also defining the radial boundaries of a recess 19 of right cylindrical shape. Fixedly positioned in said recess 19 and flush with the rim end surface 18 is a disc-shaped wear resisting insert 20 having a substantially planar wear resisting outer surface 22, an opposite surface 24 and a cylindrical edge surface 26 joining the outer surface 22 and the opposite surface 24. The wear resisting insert 20 is preferably fashioned of a highly wear resistant ceramic material such as silicon carbide. The rim end surface 18 and the wear resisting outer surface 22 form a wear face 14 at said one end 15 of the tappet 10.

The wear resisting insert 20 is retained in position by an interference fit. For example, the wear resisting insert 20 could be made very slightly larger in diameter than the diameter of the recess 19 and then forced into the recess 19 under the application of pressure to form a press fitting. Alternatively, pieces so sized could be permanently joined by elevating the temperature of the rim 17 with respect to the wear resisting insert 20 to the point where the diameter of the wear resisting insert 20 is less than the diameter of the recess 19 then the insertion is made and their temperatures allowed to reach equilibrium. These and other methods of attaining an interference fit are well known in the art. Preferably, the hoop stress resulting from this press fit will be on the order of at least 60,000 psi when measured at 20° C. It is believed that a tappet 10 satisfactory for most applications could have a hoop stress of half this amount and that a tappet 10 satisfactory for low stock applications could successfully operate with a hoop stress on the order of 3,000 psi.

As the conservation of space is an important consideration in the design of most internal combustion engines it is preferred that the tappet 10 be of as small a cross sectional area as is possible. The wear face 14 should then be so sized that the area of cam contact 28 traverses substantially the entire diameter of the wear face 14. In certain applications, especially where space conservation is very important, it would be further advantageous to fashion the relevant parts so as to yield a slightly convex wear face 14.

To minimize wear, it is also important that the wear face 14 be as smooth as possible. Toward this end the wear resisting insert 20 and the rim 17 are flush and machined so as to be smooth. It is also advantageous to select materials for the tappet main body 12 and the wear resisting insert 20 with reasonably similar coefficients of thermal expansion. This will assist in maintaining this flush condition over the range of expected operating temperatures. To further minimize wear it is preferred that the rim 17 be heat treated as is well known in the art so as to increase its resistance to wear. This hardening preferably does not extend longitudinally from the rim outer surface 18 to a position 27 beyond the wear resisting insert 20.

INDUSTRIAL APPLICABILITY

This improved tappet 10 has among its other advantages a lower rate of wear and consequently yields both a more constant valve movement over its life and a lower incidence of cam 16 damage than would a conventional tappet. The present improvement had its inception in the discovery that a cam 16 can be allowed to wear across differing materials, in the preferred embodiment cast iron and ceramic, in the tappet wear face 14. It was observed that by far the most severe shock and scuffing occurred near the center of the tappet wear face 14. It was also noted that though the cam 16 did contact portions of the wear face 14 well removed from the center the wear there was minimal.

An insert 20 of a very hard material of excellent compressive strength such as a ceramic can be placed in the center of a tappet wear face 14 such that this wear resisting insert 20 extends past the point of significant wear. Enclosing this insert and covering that area where contact exists but results in little if any abrasion can be a softer material, the metal of the tappet main body 12. This yields a tappet 10 with no greater than the minimum required area of contact yet possessing a tappet wear face 14 of adequate wear resistance inexpensively and virtually permanently attached thereto by means of an interference fit.

This tappet 10 functions just as would a conventional tappet, yet provides the aforementioned benefits. It is especially applicable for those engines where a highly wear resistant, small tappet is required.

Other aspects, objects, uses and advantages of this invention can be obtained from a study of the drawings, the disclosure and the appended claims.

We claim:

1. In an iron based alloy tappet (10) controlled by a cam (16) and being adapted for use in an internal combustion engine, comprising:

said tappet (10) having a rim (17) hardened by heat-treatment extending therefrom, said rim (17) defining a recess (19) of generally right cylindrical shape, and having a rim end surface (18);

a wear resisting ceramic insert (20) of cylindrical shape, having an outer wear resisting surface (22), said wear resisting insert (20) being retained by an interference fit within said recess (19) and being free from being overlapped by said rim (17), said rim (17) having a preselected hoop stress exceeding 3,000 pounds per square inch at 20° C.; and said rim end surface (18) and said wear resisting outer surface (22) forming a wear face (14) for cam (16) contact and remaining substantially flush over the temperature range of from about 50° C. to 200° C.

* * * * *